US008087514B1

(12) United States Patent
Fulford

(10) Patent No.: US 8,087,514 B1
(45) Date of Patent: Jan. 3, 2012

(54) BROOM WITH INTERCHANGEABLE ACCESSORIES AND CARRYING CASE THEREFOR

(76) Inventor: Kenneth W. Fulford, Raleigh, NC (US)

( * ) Notice: Subject to any disclaimer, the term of this patent is extended or adjusted under 35 U.S.C. 154(b) by 414 days.

(21) Appl. No.: 12/317,169

(22) Filed: Dec. 19, 2008

Related U.S. Application Data

(60) Provisional application No. 61/008,117, filed on Dec. 19, 2007.

(51) Int. Cl.
*A41L 13/51* (2006.01)
*A47L 13/10* (2006.01)

(52) U.S. Cl. ..... 206/576; 206/374; 206/223; 15/105

(58) Field of Classification Search ..... 206/576, 206/223, 362, 15.2, 372, 373, 374; 15/257.2, 15/257.7, 145, 159.1, 176.1, 105, 202, 257.1, 15/146

See application file for complete search history.

(56) References Cited

U.S. PATENT DOCUMENTS

| | | | | |
|---|---|---|---|---|
| 1,579,279 | A | 4/1926 | Cave | |
| 2,538,654 | A * | 1/1951 | Petersen | 403/381 |
| 3,029,455 | A | 4/1962 | Siculan | |
| 3,407,424 | A * | 10/1968 | Lanzarone et al. | 15/145 |
| 4,686,734 | A * | 8/1987 | Alexander | 15/257.1 |
| 4,769,869 | A * | 9/1988 | Benitez | 15/115 |
| 5,661,868 | A | 9/1997 | Panagakos et al. | |
| 5,799,360 | A | 9/1998 | Vosbikian | |
| 5,799,996 | A * | 9/1998 | Fredrickson | 294/51 |
| 5,921,596 | A * | 7/1999 | Sheriff et al. | 294/1.4 |
| 6,081,958 | A * | 7/2000 | Van Staagen | 15/114 |
| 6,397,427 | B1 * | 6/2002 | Bryngelsson | 15/228 |
| D468,106 | S | 1/2003 | Robertson | |
| 6,581,776 | B2 | 6/2003 | Zatkoff | |
| 6,598,257 | B2 | 7/2003 | Cavalheiro | |
| 6,902,060 | B2 * | 6/2005 | Michelson et al. | 206/576 |
| 7,000,281 | B1 * | 2/2006 | Morad | 15/106 |
| D521,201 | S | 5/2006 | Iacchetti | |
| 2007/0163069 | A1 * | 7/2007 | Sampaio | 15/257.7 |

* cited by examiner

*Primary Examiner* — Steven A. Reynolds
(74) *Attorney, Agent, or Firm* — Montgomery Patent & Design, LLC; Robert C. Montgomery; Joseph T. Yaksich

(57) ABSTRACT

A cleaning system stored within its own storage case having an integrated and collapsible handle, a dustpan, and a broom head specifically designed to sweep under furniture and other obstacles is herein disclosed. When in a broom configuration, a curved handle portion and the bristled broom head allows cleaning beneath objects. The handle can be removed from the broom portion and attached to the dustpan to remove dirt and debris. The broom head, with its own separate angled handle, may also be utilized as a whisk broom to collect the dirt and refuse into the dustpan. All components are stored in a self-contained carrying case. The storage case also has internal fasteners to secure the components of the apparatus securely therewithin.

9 Claims, 5 Drawing Sheets

BROOM WITH INTERCHANGEABLE ACCESSORIES AND CARRYING CASE THEREFOR

RELATED APPLICATIONS

The present invention was first described in U.S. Provisional Patent Application No. 61/008,117 filed on Dec. 19, 2007, the entire disclosures of which are incorporated herein by reference.

FIELD OF THE INVENTION

The present invention relates generally to a modular cleaning implement comprising a main handle assembly, an "S"-shaped extending member removably and adjustably attached to a base member portion of the main handle assembly, a broom head assembly with a removable bristle portion removably and adjustably attached to the main handle assembly, a dustpan assembly with a pivoting head adjustably attached to the main handle assembly, and a carrying case for storing and transporting the cleaning implement in a disassembled state.

BACKGROUND OF THE INVENTION

There are a number of household cleaning products that help perform a broad array of these cleaning tasks in an efficient and effective manner. Perhaps the simplest and maybe the most effective of these cleaning tools, is the broom and dustpan. Their design has basically remained unchanged for countless generations. While they do an admirable job on basic floors, they come up short when having to clean under objects, such as tables, benches, chairs, and the like. Also, the broom and dustpan cannot do their job if one (1) or the other cannot be found. There is nothing more aggravating than not being able to find the dustpan when sweeping a floor. Accordingly, there is a need for a means by which the above described efficiencies of rooms and dustpans can be addressed. The development of the invention herein described fulfills this need.

There have been attempts in the past to invent kits for storing various cleaning implements. U.S. Pat. No. 6,902,060 issued to Michelson discloses a broom and dustpan kit comprising a stand-up dustpan, a less-than-full-sized broom and a box-shaped container into which the dustpan and broom can be disposed. Unfortunately, this patent does not appear to disclose a broom with interchangeable accessories and a carrying case that comprises a broom with a segmented handle nor does it appear to disclose a removable replaceable broom head.

U.S. Pat. No. 6,598,257 issued to Cavalheiro discloses a broom with a handle opening in the head with flared out bristles projecting therefrom so as to form a leading edge for reaching into confined spaces. Unfortunately, this patent does not appear to disclose a broom with interchangeable accessories and a carrying case.

U.S. Pat. No. 6,581,776 issued to Zatkoff discloses a convertible cleaning kit comprising a housing member with a carrier and a convertible cover, a pivotal handle, a locking mechanism, a telescoping handle, holding clips and a cleaning device. Unfortunately, this patent does not appear to disclose a broom with interchangeable accessories and a carrying case that comprises a broom with a segmented handle, nor does it appear to an "S"-shaped extending member to facilitate cleaning usage of the broom in tight confined spaces.

U.S. Pat. No. 5,799,360 issued to Vosbikian discloses a combined broom and dustpan where the broom includes an elongated handle, a body of straw-like members, and a holder in which a dustpan may be releasably retained. Unfortunately, this patent does not appear to disclose a broom with interchangeable accessories and a carrying case that comprises a broom with a segmented handle, nor does it appear to disclose a removable replaceable broom head.

U.S. Pat. No. 5,661,868 issued to Panagakos et al. discloses a portable, collapsible broom with a telescoping handle and a brush portion and a dust pan that are detachably carried by the handle. Unfortunately, this patent does not appear to disclose a broom with interchangeable accessories and a carrying case.

U.S. Pat. No. 3,029,455 issued to Siculan discloses a combination collapsible broom and dust pan. Unfortunately, this patent does not appear to disclose a broom with interchangeable accessories and a carrying case, nor does it appear to an "S"-shaped extending member to facilitate cleaning usage of the broom in tight confined spaces.

U.S. Pat. No. 1,579,279 issued to Cave discloses a dustpan with a removably detachable brush. Unfortunately, this patent does not appear to disclose a broom with interchangeable accessories and a carrying case that comprises a broom with a segmented handle, nor does it appear to disclose a removable replaceable broom head.

U.S. Design Pat. No. D 468,106 issued to Robertson discloses a broom and dust pan combination and D 521,201 issued to Iacchetti disclosing a combined broom, brush and dustpan do not appear to be similar in appearance to the disclosed device. Further, neither of these patents appears to disclose a broom with interchangeable accessories that can be stored within a carrying case for easy portable and storage.

SUMMARY OF THE INVENTION

In light of the disadvantages as described in the prior art, it is apparent that there is a need for a configurable and portable system for cleaning and/or collecting dirt, soil, dust, grime, and the like in hard-to-reach areas, specifically under furniture or other objects.

An object of the broom with interchangeable accessories and carrying case is to provide a plurality of sizes to accommodate proper cleaning of various household, commercial, indoor, and outdoor cleaning applications.

A further object of the broom with interchangeable accessories and carrying case comprises sturdy plastic and metal materials utilizing standard industrial fabrication processes.

Still another object of the broom with interchangeable accessories and carrying case is to easily transport the cleaning implement in a compact state stored within a carrying case.

Yet another object of the broom with interchangeable accessories and carrying case comprises a dustpan assembly designed with a tapered front open portion allowing the easy collection of debris, soil, and/or dirt.

Yet a further object of the broom with interchangeable accessories and carrying case comprises an ergonomically designed handle portion that may be selectively altered to become an integrated and collapsible broom.

Yet still another object of the broom with interchangeable accessories and carrying case is an extending member in an "S"-shape that provides easy access under furniture and other obstacles.

An aspect of the broom with interchangeable accessories and carrying case comprises a main handle assembly further comprising a first and a second gripping device and a first locking button. The first gripping device and a second gripping device provide an ergonomic gripping means during use. The main handle assembly further comprises a spring-loaded and protruding first locking button providing a telescoping and locking attachment means to an extending member portion.

A further aspect of the broom with interchangeable accessories and carrying case comprises an extending member that comprises an "S"-shaped length of tubing which may be adjustably lengthened or shortened for a plurality of respective cleaning job functions. The extending member further comprises a plurality of equally-spaced extending member apertures arranged in a vertical linear fashion providing selectable engagement therewith the first locking button portion of said main handle assembly. The extending member further comprises a second locking button along a lower opening portion.

Still another aspect of the broom with interchangeable accessories and carrying case comprises a broom head assembly comprising a one-piece molded member further comprising a broom head body, a stationary tube receiver providing a removably securing means to the extending member, and a handle portion comprising an ergonomic horizontally extending appendage from the stationary tube receiver having a plurality of finger indentations.

Still a further aspect of the broom with interchangeable accessories and carrying case comprises a broom head assembly further comprising a plurality of bristles being collectively removably attached to a cylindrical female receiver thereof a horizontally extending cylinder portion thereof the broom head body.

Still another aspect of the broom with interchangeable accessories and carrying case comprises a dust pan assembly with a pivoting tube receiver at an intermediate position along an external surface of the rear dustpan wall enabling angular adjustment of said dustpan assembly and further providing an attachment means with the extending member by a second locking button portion and a tube receiver aperture portion of the pivoting tube receiver. The rotating function of the pivoting tube receiver is accomplished by an integrally-molded slot feature and a protruding tab feature.

Yet another aspect of the broom with interchangeable accessories and carrying case comprises a carrying case comprising a plastic folding "clamshell" design of a triangular shape providing protection to the cleaning portions of the system and providing a portable transportation means. The carrying case further comprises a plurality of integrally-molded features including a pair of opposing "U"-shaped handles, a pair of molded hinging snap fasteners with corresponding snap features, open topped storage pockets, a pair of case hinges, and a plurality of securing straps.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
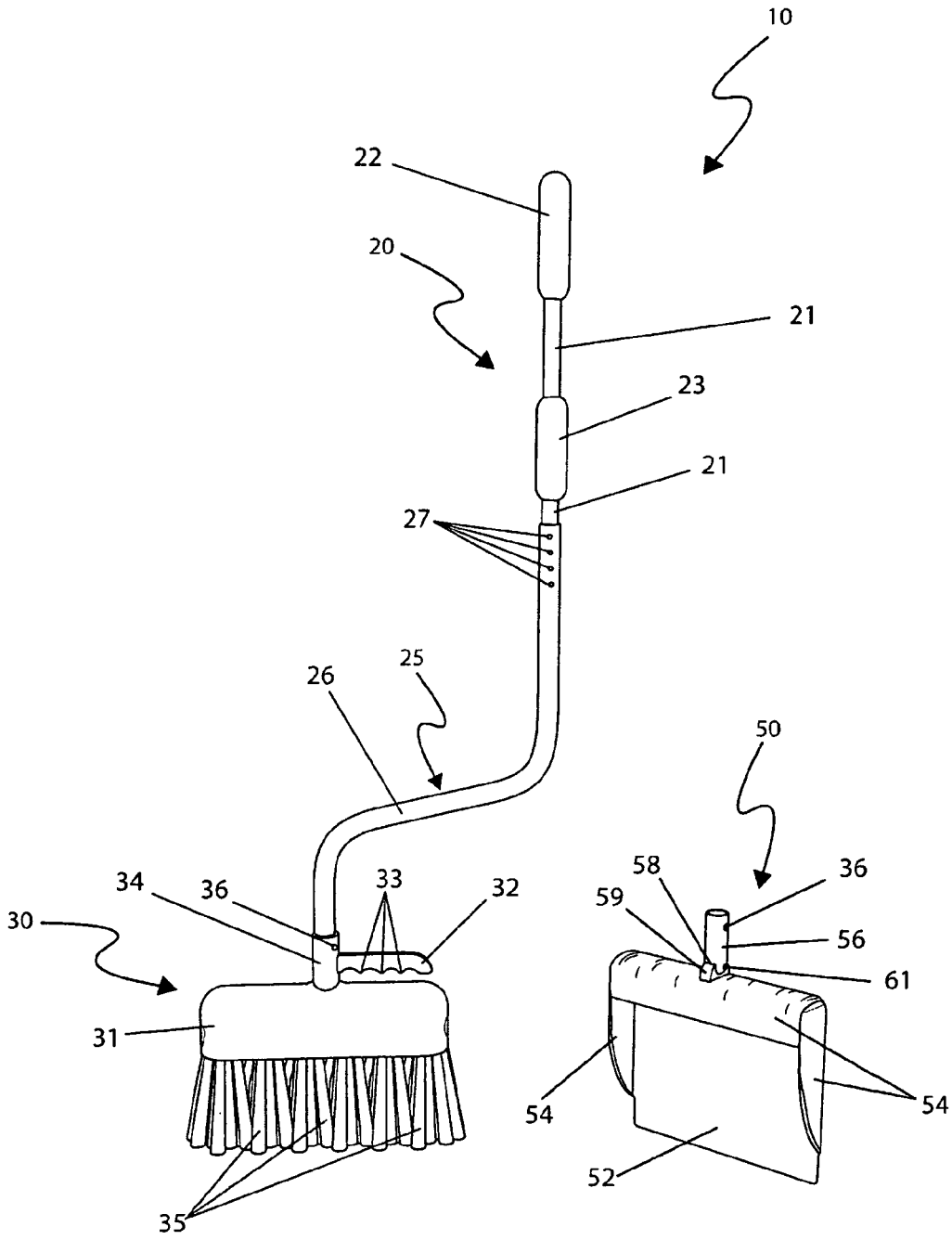
FIG. 1 is a perspective view of a broom with interchangeable accessories and carrying case therefor 10 with a dustpan 50 attachably removed therefrom, according to the preferred embodiment of the present invention.

| DESCRIPTIVE KEY | |
|---|---|
| 10 | broom with interchangeable accessories |
| 20 | main handle assembly |
| 21 | main handle tube |
| 22 | first gripping device |
| 23 | second gripping device |
| 24 | first locking button |
| 25 | extending member |
| 26 | extending member tube |
| 27 | extending member aperture |
| 28 | second locking button |
| 30 | broom head assembly |
| 31 | broom head body |
| 32 | broom head handle |
| 33 | finger indentation |
| 34 | stationary tube receiver |
| 35 | bristle |
| 36 | tube receiver aperture |
| 37 | binding |
| 38 | receiver |
| 39 | pocket |
| 50 | dustpan assembly |
| 52 | floor portion |
| 54 | dustpan wall |
| 55 | front opening |
| 56 | pivoting tube receiver |
| 58 | slot feature |
| 59 | tab feature |
| 61 | wing nut |
| 70 | carrying case |
| 72 | inner cavity |
| 74 | pocket |
| 75 | carrying case handle |
| 76 | strap |
| 78 | snap fastener |
| 80 | snap feature |
| 82 | case hinge |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a configurable and portable system for cleaning and/or collecting dirt, soil, dust, grime, and the like in hard-to-reach areas, specifically under furniture or other objects. The broom with interchangeable accessories and carrying case therefor (herein described as the "system") 10 comprises a main handle assembly 20, a broom head assembly 30 with a replaceable bristle portion 35, a dustpan assembly 50, and a carrying case 70. The system 10 comprises an ergonomically designed handle portion 20 that may be selectively altered to become an integrated and collapsible broom. The system 10 is envisioned to be introduced in a plurality of sizes to accommodate proper cleaning of various areas as well as reaching hard-to-reach areas. The system 10 is envisioned to be fabricated of sturdy plastic and metal materials utilizing standard industrial fabrication processes.

Figure 2:
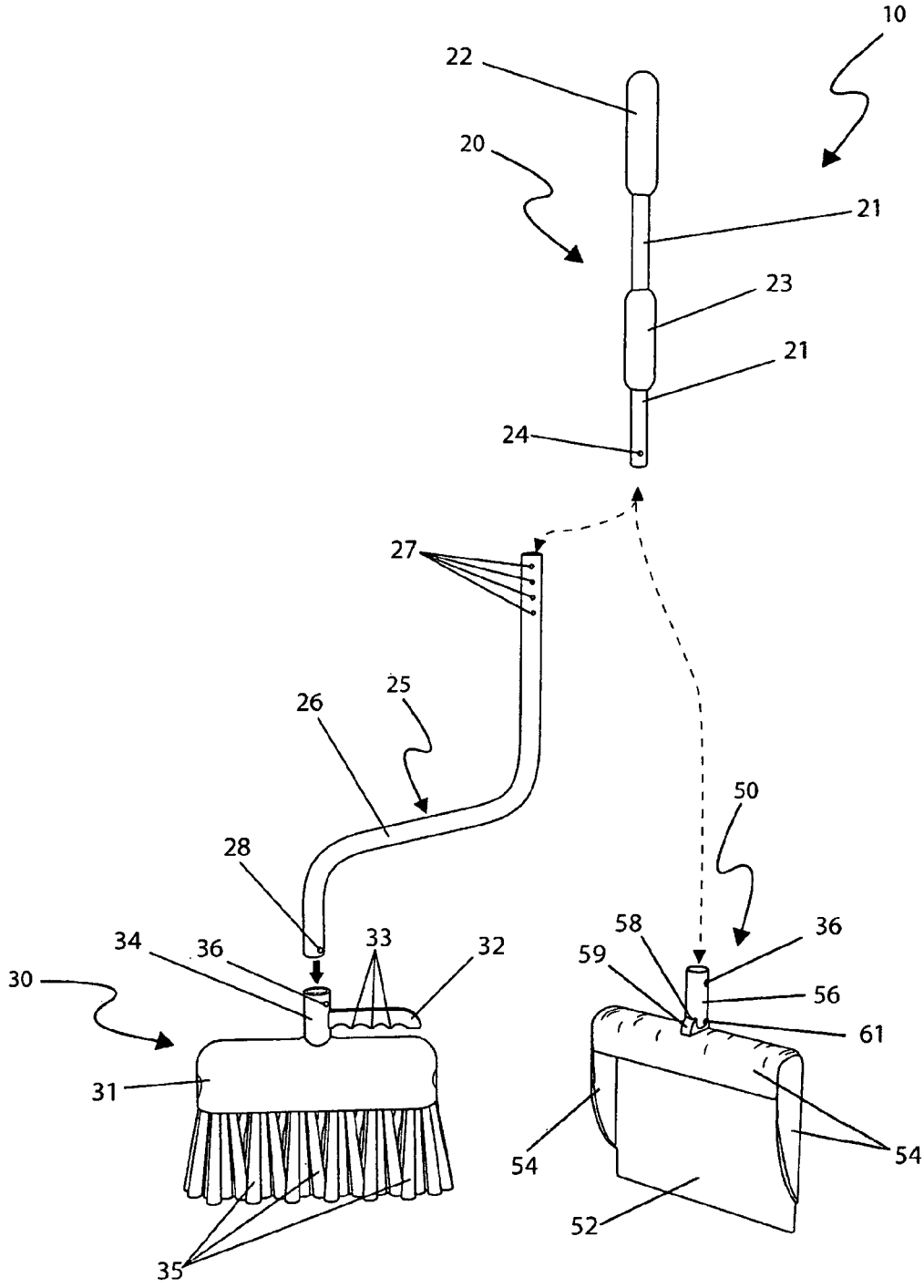
FIG. 2 is an exploded view of a broom with interchangeable accessories and carrying case therefor 10, according to the preferred embodiment of the present invention.

Referring now to FIGS. 1 and 2, a perspective view and an exploded view of the system 10, according to the preferred embodiment of the present invention, are disclosed. The system 10 comprises cleaning components which include a main handle assembly 20, an extending member 25, a broom head assembly 30, and a dustpan assembly 50. The main handle assembly 20 provides a gripping means to operate the system 10. The main handle assembly 20 is linear in shape and made using metal or plastic tubular materials with a hollow center thereby allowing the system 10 to be lightweight as well as sturdy. The main handle assembly 20 comprises an appropriate diameter and thickness for optimum stability and strength capabilities. The main handle assembly 20 comprises a first gripping device 22 and a second gripping device 23 located at upper and lower portions, respectively. The gripping devices 22, 23 comprise cylindrical lengths of dense urethane foam rubber and provide an ergonomic gripping means during use using two (2) hands. Said gripping devices 22, 23 radially envelop portions of the main handle assembly 20. The main handle assembly 20 is envisioned to further comprise a spring-loaded and protruding first locking button 24 along a lower edge, thereby providing a telescoping and locking attachment means thereto an extending member portion 25 in a similar manner as that of awning or tent posts, thereby being joined together to form a substantially single unit.

The extending member 25 comprises an "S"-shaped length of tubing which may be adjustably lengthened or shortened for a plurality of respective cleaning job functions. The extending member 25 is made using similar materials as the main handle assembly 20; however, said extending member 25 provides an upper diameter sized specifically to fit slidingly and telescopingly over the aforementioned main handle assembly 20. Thereat said telescoping and overlapping portion, the extending member 25 further comprises a plurality of equally-spaced extending member apertures 27 arranged in a vertical linear fashion providing selectable engagement therewith the first locking button portion 24 of said main handle assembly 20, thereby forming a substantial connection therebetween which may be extended for a longer length or retracted for a shorter length acting to adjust an overall vertical length of the system 10. The main handle assembly 20 and extending member 25 are envisioned to be locked into an extended orientation, a retracted orientation, or a plurality of intermediate positions therebetween via the extending member apertures 27. The main handle assembly 20 and extending member 25 may be selectively detached by depressing the spring-loaded button 24 inwardly thereby releasing said portions 20, 25 therefrom one another. The extending member 25 further comprises a second locking button 28 along a lower opening portion providing similar construction as the aforementioned first locking button 24, thereby providing a similar telescoping engagement means thereto a tube receiver aperture portion 36 of the broom head assembly 30 (see FIG. 3).

The "S" shape nature of the extending member 25 comprises a low-profile shape providing easy access thereunder furniture and other obstacles. It is envisioned that a lower end portion of the extending member 25 extends upwardly a short distance and subsequently curves and extends at an angle of approximately thirty degrees)(30° from a horizontal plane. The main handle assembly 20, extending member 25, and broom head assembly 30 are designed to provide engaging diameters such that each respective section is slightly larger than the previous to enable each section to be slidably received therewithin one another to provide convenient disassembly as well as a means to vary an overall height of the system 10. It is further understood that the main handle assembly 20 and extending member 25 may also be utilized individually being affixed thereto the broom head assembly 30, thereby providing additional configurations of the system 10 for a variety of cleaning tasks. Finally, said attachment and engagement of the main handle assembly 20, extending member 25, and broom head assembly 30 provides compact disassembly of the system 10 to be stored therein a carrying case 70 (see FIG. 5). The main handle assembly 20, extending member 25, and broom head assembly 30 are illustrated here utilizing a preferred attachment means using spring-loaded buttons 24, 28 and corresponding apertures 27, 36; however, it is understood that various other tubular attachment means may be utilized which provide equal benefit to a user such as threaded, snapping grooves, various locking clips, quick-disconnect pins, other fasteners, or the like.

The system 10 is to be introduced in a plurality of sizes to accommodate various household, commercial, indoor, and outdoor cleaning applications. Furthermore, the system 10 is envisioned being introduced having a variety of external decorative colors and patterns.

Figure 3:
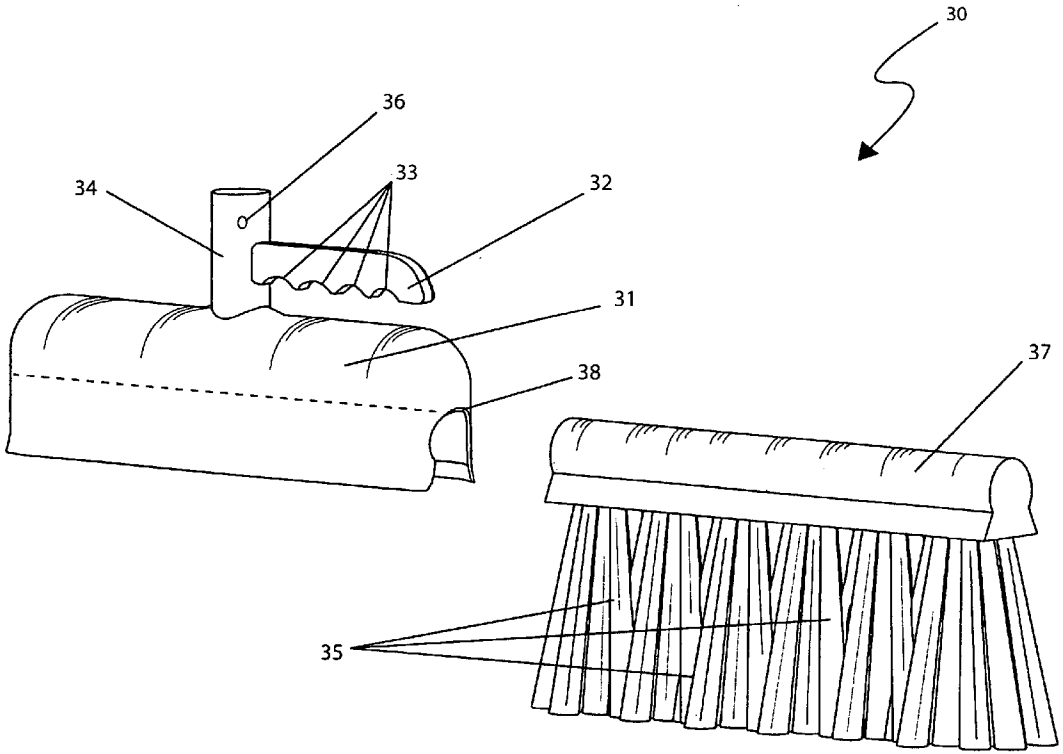
FIG. 3 is a close-up view of a broom head assembly portion 30, according to the preferred embodiment of the present invention.

Referring now to FIG. 3, a close-up view of the system 10 depicting a broom head assembly portion 30, according to the preferred embodiment of the present invention, is disclosed. The broom head assembly 30 is removably attached thereto the lower-most extremity of the extending member 25, if so configured (see FIG. 1). The broom head assembly 30 extends perpendicularly in both directions therewith a longitudinal axis of the extending member 25. The broom head assembly 30 comprises a one-piece molded member further comprising a broom head body 31, a handle 32, and a stationary tube receiver 34. The stationary tube receiver 34 provides a removably securing means thereto the extending member 25 as previously described such to permit normal sweeping. The handle portion 32 may be utilized to grasp said broom head assembly 30 to be utilized as a whisk broom while attachably removed therefrom the extending member 25. The handle 32 comprises an ergonomic horizontally extending appendage therefrom the stationary tube receiver 34 having a plurality of finger indentations 33 sized and positioned to removably receive fingers of a user. The broom head assembly 30 further comprises a plurality of bristles 35 being collectively removably attached thereto said broom head assembly 30. The broom head assembly 30 comprises a broom head body 31 comprising a horizontally extending cylinder shape further comprising an included cylindrical female receiver feature 38 along an entire lower surface providing a firm interference fit therewith a corresponding cylinder-shaped binding portion 37. The receiver 38 and binder 37 provide a removably attachable clamping means providing convenient removal thereof a plurality of bristles 35 affixed thereto said binder 37 when worn and/or in need of replacement. The binder 37 comprises a length correspondingly matching that of the broom head body 31 and is envisioned to be made of similar materials as said broom head assembly 30. The binding 37 and bristles 35 are envisioned being securely affixed thereto one another using conventional broom assembly techniques utilizing a plurality of bored holes designed to receive tufts or bundles of bristles 35 being secured thereinto using common adhesives; however, various other fastening means may be provided such as staples, other fasteners, or the like. The bristles 35 are envisioned to comprise a plurality of natural and/or synthetic strands and may be tufted in a variety of sizes and/or configurations, including a cylindrical shape, a rectangular shape, an oval shape, or various other regular or irregular shapes. The bristles 35 are to flare outwardly therefrom leading and/or trailing edges of the binder 37 thereby permitting the user to extend the bristles 35 in tight spaces; for example, between a piece of furniture, along a wall, or the like.

Figure 4:
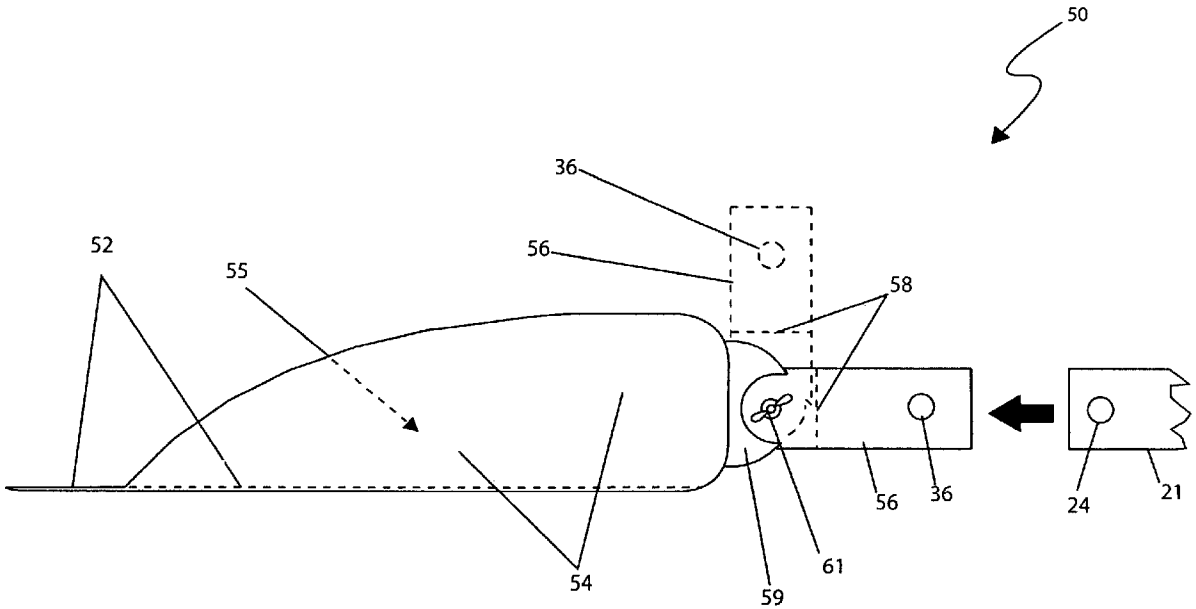
FIG. 4 is a side view of a dustpan assembly portion 50, according to the preferred embodiment of the present invention; and, FIG. 5 is a perspective view of the broom with interchangeable accessories and carrying case therefor 10 disassembled and stored accordingly therein a carrying case 70, according to the preferred embodiment of the present invention.

Referring now to FIG. 4, a side view of a dustpan assembly portion 50 of the system 10, according to the preferred embodiment of the present invention, is disclosed. The system 10 comprises a dustpan assembly 50 being removably attachable thereto the extending member 25. The dustpan assembly 50 provides an accessory thereto the system 10, when it is so desired, for collection of dirt, soil, debris, and other undesirables thereupon a surface. The dustpan assembly 50 is substantially rectangular with three (3) upwardly extending dustpan walls 54 acting as mechanical barriers thereby providing accessibility thereto a floor portion 52 through a frontward-facing open portion 55. The front opening 55 is envisioned to be tapered downwardly to permit easy collection of dirt, debris, and/or other undesirables. The dustpan assembly 50 is envisioned being made using plastic or other equivalent materials. The floor portion 52 is further envisioned to comprise standard features found on common dustpans such as ridges to provide as a gripping means thereto included dirt, a seal along a forward edge to seal against an underlying surface, and the like. The dustpan assembly 50 further comprises a pivoting tube receiver 56 thereat an intermediate position along an external surface of the rear dustpan wall 54, thereby enabling angular adjustment of said dustpan assembly 50 with regards to the attached extending member 25 (see FIG. 2). The dustpan assembly 50 provides an attachment means therewith the extending member 25 via engagement of the second locking button portion 28 and a tube receiver aperture portion 36 of the pivoting tube receiver 56 located along an upper edge. Engagement of said second locking button 28 and aperture 36 functions in a similar manner as that of the previously described attachment of the broom head assembly 30. The rotating function of the pivoting tube receiver 56 is accomplished via an integrally-molded slot feature 58 and a protruding tab feature 59 being integrally molded thereinto the rear dustpan wall 54. Said slot 58 and tab features 59 are in mechanical communication therewith one another via a rotary connection comprising a tightening wing nut 61, thereby forming an angular adjustable axle mechanism providing infinitely selectable and lockable positions therebetween a horizontal orientation and a vertical orientation as shown here.

Figure 5:
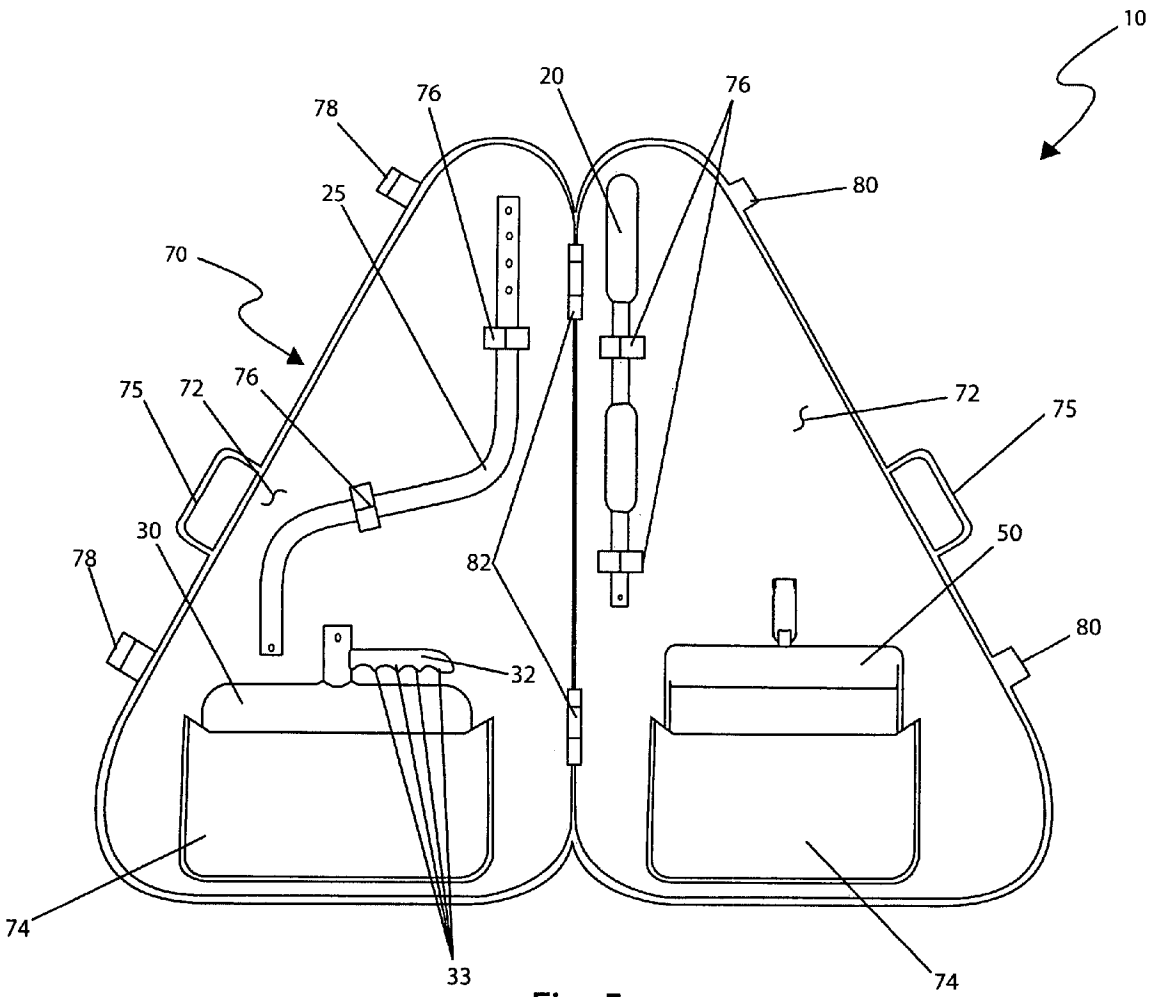

Referring now to FIG. 5, a perspective view of the system 10 disassembled and stored accordingly therein a carrying case 70, according to the preferred embodiment of the present invention, is disclosed. The carrying case 70 comprises a plastic folding "clamshell" design of a triangular shape providing protection thereto cleaning portions of the system 10 as well as providing a portable transportation means. The carrying case 70 comprises an overall inner cavity 72 sizable so as to accommodate and protect the cleaning portions of the system 10 as well as provide a pair of internal open-topped storage pockets 74 to facilitate in static placement of the broom head 20 and dustpan 50 assemblies. It is understood that main assemblies 20, 25, 30, 50 are to be disassembled and disposed therewithin the carrying case 70 for storage and/or transportation. The interior pockets 74 provide generally rectangular enclosures particularly sized so as to snuggly contain said broom head assembly 30 and dustpan assemblies 50. Said pockets 74 are envisioned being made using rigid or semi-rigid extruded plastic sheets being affixed thereto a lower portion of the inner cavity 72 of the carrying case 70 using common plastic welding processes. The carrying case 70 further comprises a plurality of securing straps 76. The straps 76 comprise standard lengths of elastic strapping or hook-and-loop fastener material providing an entrapping and securing means thereto the main handle assembly 20 and extending member 25 thereto an inner wall portion of the carrying case 70. The straps 76 are envisioned being affixed thereto said carrying case 70 using a common fastening means such as double-face adhesives, rivets, or the like. The carrying case 70 further comprises a plurality of integrally-molded features including a pair of opposing "U"-shaped handles 75, a pair of molded hinging snap fasteners 78 with corresponding snap features 80, and a pair of case hinges 82 along an adjacent mirrored vertical edge portion. Said molded features 75, 78, 80, 82 provide a latching and carrying means thereto the carrying case 70. Whenever it is so desired, half portions of the "clamshell" design of the carrying case 70 may then be pivoted thereabout the molded-in case hinges 82, closed thereagainst abutting outer perimeter edges thereof, and subsequently secured theretogether in a folded form via the hinging snap fasteners 78. The snap fasteners 78 are extended and forced over corresponding molded protruding snap features 80 along an edge region of an opposing half portion of the carrying case 70. Said snap fasteners 78 and snap features 80 are envisioned to be similar thereto like devices used on plastic fishing tackle boxes, plastic tool kits, and the like; however, it is understood that other common latching devices may be provided to secure the carrying case 70 such as hook-and-loop fasteners, button snaps, and the like, while providing equal benefit.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. The present invention describes a means by which a cleaning system 10 may be utilized in a plurality of fashions with the accommodation of easy transportation thereof. After initial purchase or acquisition of the system 10, it would be configured as indicated in FIGS. 2 and 5.

The method of utilizing the system may be achieved by performing the following steps: opening the carrying case 70 by unlatching the snap fasteners 78 therefrom the snap features 80; unfolding half portions of the carrying case 70, thereby exposing the interior cavity 72; unfastening the straps 76 therefrom the individual portions of the system 10; inserting a lower portion of the main handle assembly 20 thereinto the extending member 25; adjusting a length of the extending member 25 to be shortened and lengthened as desired for operation or storage using the first locking button 24 and the extending member apertures 27, as desired; removably attaching the broom head assembly 30, if desired or; attaching the dustpan assembly 50 thereto the extending member 25; using the system 10 in the assembled form, to sweep a desired surface by; grasping the gripping devices 22, 23 and motioning in a sweeping motion contacting the desired floor surface;

manipulating the bristles 35 of the broom head assembly 30 thereby moving debris, dirt, soil, and/or other undesirable substances in a desired direction; utilizing the broom head assembly 30 being removed therefrom the extending member 25, as a whisk broom using the handle portion 32; using the dustpan assembly 50 either in a stand-alone state or alternately affixed thereto the main handle assembly 20 or the extending member 25; adjusting a relative operating angle of said dustpan assembly 50 if desired, using the wing nut 61; gathering said debris and dirt by utilizing the dustpan assembly 50; replacing the binding 37 and affixed bristles 35 in such an event as when said bristles 35 become worn and require replacement by manually removing the binding portion 37 therefrom the receiver portion 38 thereupon the broom head assembly 30; installing new bristle 35 and binding 37 portions by inserting the binding 37 thereinto the receiver portion 38; disassembling the cleaning portions of the system 10 after use; placing the broom head assembly 30 and dustpan assembly 50 portions of the system 10 within the carrying case 70 using the pockets 74; securing the main handle assembly 20 and extending member 25 portions therewithin the carrying case 70 using the strap portions 76; folding and fastening the two (2) halves of the carrying case 70 using the snap fasteners 78; transporting the system 10 using the carrying case handle 75.

The system 10 is envisioned to be easily transportable in a compact state stored within a carrying case 70. The carrying case 70 also provides a means to protect the cleaning mechanisms therewithin via straps 76. Once desired for utilization, the system 10 may then be fully assembled with minimal time and effort. The dustpan assembly 50 is designed with a front open portion 55 being tapered thereby allowing the easy collection of debris, soil, dirt, and/or other undesirables. The dustpan assembly 50 may then be attached thereto the extending member 25 or the main handle assembly 20 disposed substantially in a perpendicular or parallel arrangement therewith the extending member 25 or the main handle assembly 20 using adjustable characteristics of the pivoting tube receiver 56.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A kit comprising a cleaning implement comprising interchangeable accessories comprising:

said cleaning implement, further comprising:

a main handle assembly;

a broom head assembly adjustably and removably attached to said main handle assembly with a first attachment means; and, a dustpan assembly adjustably and removably attached to said main handle assembly with a second attachment means; and, a carrying case having a triangular clamshell design for carrying said cleaning implement when in a disassembled state, said carrying case further comprising:

an overall inner cavity sizable so as to accommodate and protect said cleaning implement in said disassembled state, comprising a first half hingedly attached to a second half at hinged peripheral edges thereof, opposite opening edges;

a first internal open-topped storage pocket to facilitate in static placement of said broom head assembly;

a second internal open-topped storage pocket to facilitate in static placement of said dustpan assembly;

a plurality of first securing straps providing an entrapping and securing means to said main handle assembly to an inner wall portion of said inner cavity;

a plurality of second securing straps providing an entrapping and securing means to an extending member to an inner wall portion of said inner cavity;

a pair of opposing "U"-shaped handles hingedly affixed on opposing exterior walls of said opening edges of said first half and said second half;

a first hinging snap fastener and a first corresponding snap feature hingedly affixed on opposing exterior walls of said opening edges of said first half and said second half at a first location; and, a second hinging snap fastener and a second corresponding snap feature hingedly affixed on opposing exterior walls of said opening edges of said first half and said second half at a second location;

wherein said pair of "U"-shaped handles abut against each other to form a handle when said carrying case is closed and both opposing opening edges of said first half and said second half abut each other;

wherein said first hinging snap fastener mates with said first corresponding snap feature to provide a first securing means;

wherein said second hinging snap fastener mates with said second corresponding snap feature to provide a second securing means;

wherein said first securing means and said second securing means provide a secure closing means for said carrying case.

2. The kit of claim 1, wherein said main handle assembly further comprises:

a linear hollow tubular base member;

a first gripping device radially enveloping an upper portion of said base member;

a second gripping device radially enveloping a lower portion of said base member;

said extending member telescopically engaging said base member at a terminal end of said lower portion; and, a first locking mechanism for securing said extending member to said base member;

wherein said main handle assembly provides a gripping means to operate said cleaning implement;

wherein said first gripping device and said second gripping device each provide an ergonomic gripping means during use; and, wherein said extending member is selectively and adjustably extended or retracted relative to said base member.

3. The kit of claim 2, wherein said first gripping device and said second gripping device are each comprised of a dense urethane foam rubber.

4. The kit of claim 1, wherein said extending member further comprises:

a hollow tubular "S"-shaped member, comprising an upper portion, a middle portion, and a lower portion;

a plurality of equidistant apertures arranged in a vertical linear fashion located at said upper portion of said "S"-shaped member; and, a second locking mechanism located at said lower portion of said "S"-shaped member;

wherein said "S"-shaped member provides easy access under furniture and other obstacles during cleaning;

wherein said plurality of equidistant apertures provides a selectable engagement with said first locking mechanism;

wherein said second locking mechanism provides said first attachment means for said broom head assembly; and, wherein said second locking mechanism provides said second attachment means for said dustpan assembly.

5. The kit of claim 4, wherein said middle portion deflects from each of said upper portion and said lower portion at approximately thirty degrees.

6. The kit of claim 4, wherein said first locking mechanism and said second locking mechanism is a spring-loaded button.

7. The kit of claim 1, wherein said broom head comprises a one-piece molded member further comprising;

a broom head body;

a bristle assembly removably attachable to said broom head body, comprising a binder bonding a plurality of bristles thereto; and, a stationary tube receiver comprising:

a centrally-located vertically extending member from said broom head body comprising a means to slidingly engage a terminal end of a lower portion of said extending member; and, a first tube receiver aperture for correspondingly receiving a second locking mechanism of said extending member; and, a handle comprising an ergonomic horizontally extending appendage from said stationary tube receiver having a plurality of finger indentations located on a bottom surface thereof.

8. The kit of claim 7, wherein said broom head body further comprises a horizontally extending cylinder shape further comprising an included cylindrical female receiver feature along an entire lower surface providing a firm interference fit with said binder.

9. The kit of claim 1, wherein said dustpan assembly further comprises:

two upwardly extending dustpan side walls;

an upwardly extending rear dustpan wall interconnecting said side walls;

a frontward-facing open portion downwardly tapered;

a floor portion comprising; and, a pivoting tube receiver comprising:

a centrally-located vertically extending member from said rear dustpan wall comprising a means to slidingly engage a terminal end of a lower portion of said extending member;

a second tube receiver aperture for correspondingly receiving a second locking mechanism of said extending member; and, an integrally-molded slot feature and a protruding tab feature being integrally molded into said rear dustpan wall and in mechanical communication with each another via a rotary connection comprising a tightening wing nut;

wherein said pivoting tube receiver provides an infinitesimal selectable and securable angular adjustment position of said dustpan assembly with regards to said extending member.

* * * * *